United States Patent [19]

Gange

[11] Patent Number: 4,532,452

[45] Date of Patent: Jul. 30, 1985

[54] CATHODE STRUCTURE FOR A CATHODOLUMINESCENT DISPLAY DEVICES

[75] Inventor: Robert A. Gange, Belle Mead, N.J.

[73] Assignee: RCA Corporation, Princeton, N.J.

[21] Appl. No.: 547,038

[22] Filed: Oct. 31, 1983

[51] Int. Cl.[3] ..... A47B 88/00

[52] U.S. Cl. ..... 313/346 R; 313/341

[58] Field of Search ..... 313/341, 346 R

[56] References Cited

U.S. PATENT DOCUMENTS

| | | | |
|---|---|---|---|
| 2,172,207 | 9/1939 | Kolligs et al. | 313/341 X |
| 2,409,769 | 10/1946 | Leyshon | 313/346 R X |
| 3,041,209 | 6/1962 | Beggs | 313/346 R X |
| 3,056,061 | 9/1962 | Melsert | 313/346 R |
| 3,558,965 | 1/1971 | Javorik et al. | 313/270 |
| 3,558,966 | 1/1971 | Hill et al. | 313/341 X |
| 3,594,601 | 1/1970 | Blumenberg | 313/82 |
| 4,009,409 | 2/1977 | Buescher et al. | 313/337 |
| 4,053,807 | 10/1977 | Aozuka et al. | 313/409 |
| 4,129,801 | 12/1978 | Soeno et al. | 313/346 |
| 4,150,318 | 4/1979 | Kerstetter | 313/340 |
| 4,151,440 | 4/1979 | Buescher | 313/340 |
| 4,220,891 | 9/1980 | Ando et al. | 313/346 R X |

*Primary Examiner*—Robert Lindsay

*Attorney, Agent, or Firm*—E. M. Whitacre; D. H. Irlbeck; L. L. Hallacher

[57] ABSTRACT

A cathode for a cathodoluminescent display device includes a plurality of low coefficient of expansion support columns arranged in a substantially parallel spaced relationship, a resistive cathode heater member extends between and is permanently affixed to the support columns. An electron emissive coating is on a portion of the cathode heater member between the columns.

4 Claims, 2 Drawing Figures

CATHODE STRUCTURE FOR A CATHODOLUMINESCENT DISPLAY DEVICES

BACKGROUND OF THE INVENTION

This invention relates generally to cathodes for cathodoluminescent display devices and particularly to a low power cathode having high dimensional precision and low thermal expansion.

Kinescopes for color television receivers and flat panel display devices, such as that described in U.S. Pat. No. 4,031,427, generate a visual display by scanning a phosphor screen with electrons. The electrons are provided by a cathode which is coated with emissive material. The cathode is heated, either directly or indirectly, to cause the emissive material to emit electrons. The electrons are passed through a focusing structure which focuses them into beams. The beams are modulated with the video information to produce the desired display on the phosphor screen as the beams are scanned across the screen. Directly heated cathodes are advantageous because they have low power consumption and short warm up times. However, in such cathodes the heating current passes directly through the cathode. However it is difficult to make a low power cathode that is precisely located with respect to the grids. The reason is that heat is lost thru the conducting parts which carry the heater current. Extending the conductors increases their length and thermal impedance, thereby lowering heat loss. But small location errors of the conductors are multiplied by the long 'lever arm' and location accuracy of the cathode is lost. Likewise rigidity of the supporting conductors decreases, thereby decreasing the location accuracy of the cathode. Reducing the cross section of the conductors to increase the thermal impedance likewise reduces rigidity, and lowers the precision with which the cathode can be located with respect to the grids. In addition, the conducting members that carry cathode heater current thermally expand as the temperature rises. The cathode support members, therefore, thermally expand and contract as the cathode heats and cools. The continual thermal expansion and contraction produces a loss in the location accuracy of the cathode, and may cause permanent thermal deformation which adversely affects the operational characteristics of the cathode and which thus also degregates the operational characteristics of the tube. There therefore is a need for a low power cathode having high dimensional precision and low thermal expansion while simultaneously being easy and inexpensive to manufacture. The instant invention fulfills these needs.

SUMMARY

A cathode for a cathodoluminescent display device includes a plurality of insulative, low coefficient of expansion, support columns arranged in a substantially parallel spaced relationship, a resistive cathode heater member extends between and is permanently affixed to the support columns. An electron emissive coating is on a portion of the cathode heater member between the columns.

DETAILED DESCRIPTION OF THE PREFERRED EMBODIMENT

Figure 1:
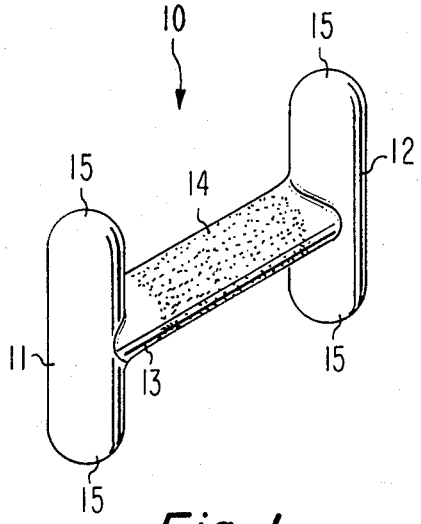
FIG. 1 is a preferred embodiment of the present invention.

In FIG. 1, a cathode 10 includes two insulative support columns 11 and 12 arranged in a spaced substantially parallel relationship. Extending between the support columns 11 and 12 in the proximity of the columns is a cathode heater member 13. The heater member 13 is coated with an electron emissive material 14 which emits electrons when heated. The columns 11 and 12 are preferably circular in cross section, and can have a diameter in the order of 7 mils. The columns can be about 50 to 100 mils in length. The heater member 13 while preferably circular in cross section, can be molded into any shape. The cathode heater member length is about 500 to 1000 mils.

The support columns 11 and 12 and the heater member 13 are formed of an insulative material capable of withstanding the high operating and oxide activation temperatures of the order of 1400° K. The material from which the support columns 11 and 12 and the cathode heater member 13 are formed must also exhibit very low thermal conductivity and expansion upon heating. Such material can be, for example, ceramic or quartz. The support columns 11 and 12 and the cathode heater 13 are metalized with a thin layer of high resistance but conductive material about 1 to 4 microns in thickness. This material, for example, can be tungsten.

The cathode 10 of FIG. 1 can be fabricated by hot pressing sintered powdered quartz in a mold of appropriate configuration. Pressing of this type is well known in the art and is within the purview of those skilled in the art. After molding, the integral structure including the support columns 11 and 12 and the cathode heater member 13 can be flame polished to smooth the surface of the cathode. During flame polishing, the ends 15 of the support columns 11 and 12 preferably are made moltent and surface tension forms the quartz into a hemispherical shape in accordance with the properties of the quartz. The hemispherical ends 15 of the columns 11 and 12 thus provide convenient and uniform surfaces for deposit of electrical contacts for connecting the heater current supply to the cathode. After the flame polishing, the entire cathode 10 including the columns 11 and 12 and the heater 13 are metalized with the tungsten layer and the entire surface of the cathode is conductive. In operation, the heater current passes through the highly resistive tungsten coating and heats the emissive material 14 on the heater member 13. The emissive material emits electrons which are formed into beams to produce the visual display.

It has been found that when the heater current is initially passed through the tungsten metalizing layer during cathode activation, the tungsten aneals. This condition acts to relieve residual stresses in the metalizing layer. Accordingly, when the cathode cools the tungsten layer goes into tension. This tension results in a very stable cathode with the tungsten circumferentially stabilized about the ceramic or quartz substrate. When the cathode is reheated, the tension is partially relaxed, and the tungsten does not expand. Additionally, the quartz substrate has a very low coefficient of expansion and thus remains dimensionally stable. For these reasons, any tendency the tungsten may have to peel away from the insulative substrate is substantially decreased and for practical purposes is eliminated.

The cathode 10 of FIG. 1 has several distinct advantages. The cathode can be readily manufactured at very low cost. The use of the rounded ends 15 for electrical contact make it very convenient to apply the heater current to the cathode. Additionally, a low heating current can be used in the operation of the cathode and, accordingly, the power consumption also is low, for example, approximately 600 milliwatts. Additionally, the very low, near zero, thermal expansion of the quartz columns and heater and the tungsten metalized coating result in the maintenance of high dimensional precision for the cathode during heating and cooling. Also, because the cathode can be made by hot pressing sintered quartz, precise cathode dimensions can be inexpensively attained.

Figure 2:
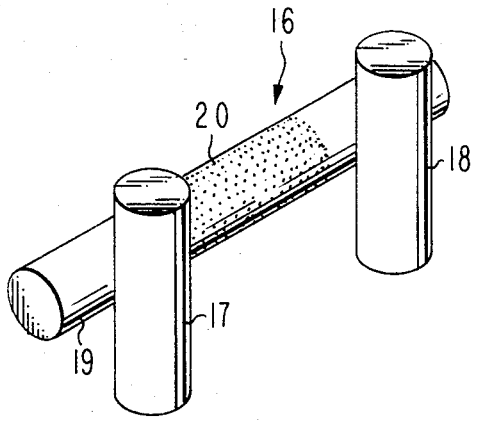
FIG. 2 is a second preferred embodiment of the present invention.

In FIG. 2, a cathode 10 includes two quartz support columns 17 and 18 which are substantially cylindrical in configuration. Extending between the support columns 17 and 18 is a solid tungsten wire 19 a portion of which is coated with an electron emissive material 20. The tungsten wire 19 can be brazed to the insulative columns 17 and 18 in the proximity of the mid points of the columns. A tenacious bond between the quartz columns 17 and 18 and the tungsten wire 20 can be attained using several metal combinations in conjunction with titanum participated from a hydride. Suitable combinations for the braze include palladium-gold, palladium-nickel or palladium-cobalt to ensure a tungsten quartz contact integrity to temperatures above 1400° K. Alternatively, if desired, the tungsten wire 19 can be embedded into the quartz columns 17 and 18 by heating the columns to a semimolten state and pressing the wire into the columns. The columns 17 and 18 can be of the order of 10 to 15 mils in diameter and 50 to 100 mils in length. The tungsten wire 19 can be approximately 6 to 14 mils in diameter and 1000 mils in length.

In the cathode 16 of FIG. 2, the heater current is supplied by connecting the current source to either of the ends of the tungsten wire 20. The quartz columns have a very low coefficient of expansion and therefore dimensional stability is maintained as the cathode heats and cools. Additionally, the use of the quartz columns 17 and 18 permits the cathode 16 to be insulatively supported with a minimum of space.

What is claimed is:

1. A cathode for a cathodolumiscent display device comprising:

a plurality of substantially cylindrical, insulative support columns arranged in a substantially parallel spaced relationship, said columns being made of a material having a low coefficient of expansion;

a cathode heater member extending between and permanently affixed to said support columns;

a thin coating of high resistance metal on said columns and on said cathode heater member for electrically connecting said columns and said heater member; and an electron emissive coating on a portion of said cathode heater member between said columns.

2. The cathode of claim 1 wherein said support columns and said cathode heater member are composed of sintered quartz.

3. The cathode of claim 1 wherein said support columns and said cathode heater member are composed of quartz.

4. The cathode of claim 1 wherein said cathode heater member is affixed to said support columns at the proximity of the centers of said columns.

* * * * *